US008979148B1

(12) United States Patent
Hatton, II

(10) Patent No.: US 8,979,148 B1
(45) Date of Patent: Mar. 17, 2015

(54) FLY JIB FOR A CRANE AND METHOD OF USE

(71) Applicant: Gary Michael Hatton, II, San Ramon, CA (US)

(72) Inventor: Gary Michael Hatton, II, San Ramon, CA (US)

( * ) Notice: Subject to any disclaimer, the term of this patent is extended or adjusted under 35 U.S.C. 154(b) by 0 days.

(21) Appl. No.: 13/788,452

(22) Filed: Mar. 7, 2013

(51) Int. Cl.
*B66C 1/10* (2006.01)
*B66C 23/62* (2006.01)
*B66C 23/42* (2006.01)

(52) U.S. Cl.
CPC ..... *B66C 23/62* (2013.01); *B66C 23/42* (2013.01)
USPC ..... 294/67.5; 294/67.1; 212/196

(58) Field of Classification Search
CPC ..... B66C 1/105; B66C 1/10; B66C 23/26; E04G 21/16
USPC ..... 294/67.1, 67.5, 81.3; 212/195, 196, 212/197, 284, 285, 294
See application file for complete search history.

(56) References Cited

U.S. PATENT DOCUMENTS

| | | | | | |
|---|---|---|---|---|---|
| 3,596,968 | A * | 8/1971 | Holm | 294/81.3 |
| 3,675,961 | A * | 7/1972 | Wheeler | 294/67.1 |
| 3,762,755 | A * | 10/1973 | Saether | 294/67.21 |
| 3,955,844 | A * | 5/1976 | de Castella et al. | 294/67.1 |
| 4,017,109 | A * | 4/1977 | Belinsky | 294/67.21 |
| 4,251,098 | A * | 2/1981 | Belinsky | 294/67.21 |
| 4,433,830 | A * | 2/1984 | Campbell | 254/264 |
| 4,648,647 | A * | 3/1987 | Patton | 294/67.1 |
| 5,609,260 | A * | 3/1997 | Liao | 212/279 |
| 5,800,000 | A * | 9/1998 | Shockley | 294/81.3 |
| 7,891,718 | B2 * | 2/2011 | Heinaman | 294/81.3 |
| 8,317,244 | B1 * | 11/2012 | Schuyleman | 294/67.5 |
| 8,840,158 | B2 * | 9/2014 | Leibovitz | 294/67.5 |
| 2014/0001782 | A1 * | 1/2014 | Leibovitz | 294/67.5 |

OTHER PUBLICATIONS

Fly Jibs Having a Moving Counterweight Have Been Known in the Art for Many Years.

* cited by examiner

*Primary Examiner* — Paul T Chin
(74) *Attorney, Agent, or Firm* — Ted Masters

(57) ABSTRACT

A fly jib for a crane having a load block includes a variable length beam to which a load can be connected. A rotation mechanism is connected to the variable length beam, and is connectable to the load block so that said rotational mechanism can selectively rotate the variable length beam with respect to the load block. A balance mechanism is connected to the variable length beam, the balance mechanism automatically keeps the variable length beam in a horizontal position.

14 Claims, 10 Drawing Sheets

FLY JIB FOR A CRANE AND METHOD OF USE

CROSS REFERENCE TO RELATED APPLICATION

None

TECHNICAL FIELD

The present invention pertains generally to cranes and the use of same for moving loads, and more particularly to a fly jib which is used to position the lifted load.

BACKGROUND OF THE INVENTION

A fly jib is a lifting device which assists a crane operator in picking and placing a load at a target area. A fly jib is particularly useful in that it allows the crane operator to place the load, such as construction materials, inside a multistory building. A problem exist however in that the fly jib has no rotation mechanism, and as such must be manually rotated by personnel using long poles to align the load with the target area. Additionally, the fly jib does not have a way of extending its length so that the load can be moved toward the target area without having to move the supporting crane.

BRIEF SUMMARY OF THE INVENTION

The present invention is directed to a fly jib which overcomes the problems of prior art devices. The fly jib disclosed herein can both selectively rotate the load to a desired angular position, and once in position, selectively extend the load toward a target area. During air transport, the fly jib is automatically keep horizontal by a balance system. The rotation and extension are performed by an operator using a remote radio control system.

In accordance with an embodiment, a fly jib for a crane having a load block includes a variable length beam having a load connection end and an opposite end. A rotation mechanism is connected to the variable length beam, the rotation mechanism being connectable to the load block so that the rotational mechanism can selectively rotate the variable length beam with respect to the load block. A balance mechanism is connected to the variable length beam, the balance mechanism keeps the variable length beam in a balanced horizontal position.

In accordance with another embodiment, the variable length beam includes a main beam, a load beam connected to the main beam, and a telescoping beam, the telescoping beam received by and selectively extendable from the load beam.

In accordance with another embodiment, the load beam is selectively positionable to an outwardly extended position co-linear with the main beam, and to a folded back position parallel to the main beam.

In accordance with another embodiment, the rotation mechanism includes a plurality of support arms which are connectable to the load block. A bearing rotationally connects the support arms to the main beam so that the main beam can be rotated with respect to the support arms.

In accordance with another embodiment, the plurality of support arms are each connected to the bearing by two bolts. One of the bolt is removable so that the support arm can be placed in a folded storage position.

In accordance with another embodiment, the balance mechanism includes a movable counterweight which is connected to the main beam, wherein the counterweight is selectively longitudinally positionable along the main beam by a chain drive mechanism. A sensor is connected to the main beam, the sensor sensing when the main beam is not horizontal and providing a signal to the chain drive mechanism, the signal causing the chain drive mechanism to move the counterweight until the main beam is horizontal.

In accordance with another embodiment, the chain drive mechanism includes a chain which is connected to the counterweight. During positioning of the counterweight by the chain drive mechanism, the chain is always in tension.

In accordance with another embodiment, the fly jib is connectable to a load. The counterweight has a retracted position wherein the counterweight resides substantially below the rotation mechanism. The retracted position being used when the fly jib is disconnected from the load.

Other embodiments, in addition to the embodiments enumerated above, will become apparent from the following detailed description, taken in conjunction with the accompanying drawings, which illustrate, by way of example, the principles of the fly jib and method of use.

DETAILED DESCRIPTION OF THE INVENTION

Figure 2:
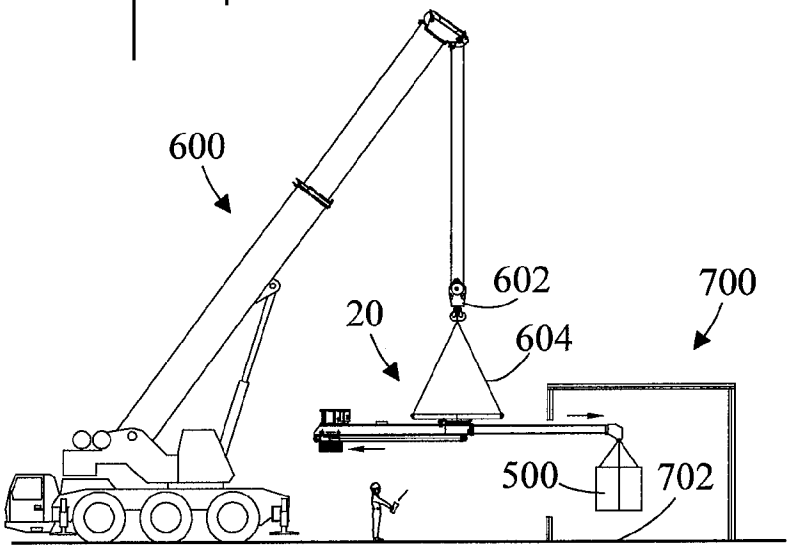
FIG. 2 is a reduced side elevation view of the fly jib being extended to place the load.
Figure 1:
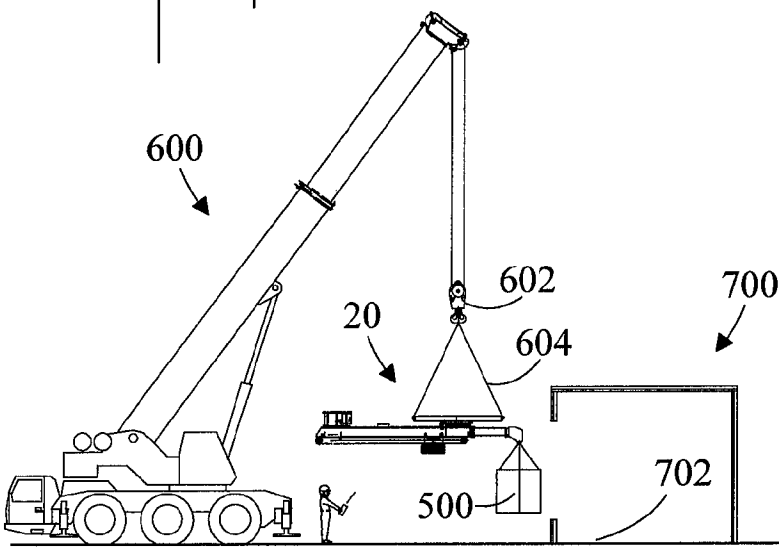
FIG. 1 is a reduced side elevation view of a fly jib being used to place a load.
Figure 3:
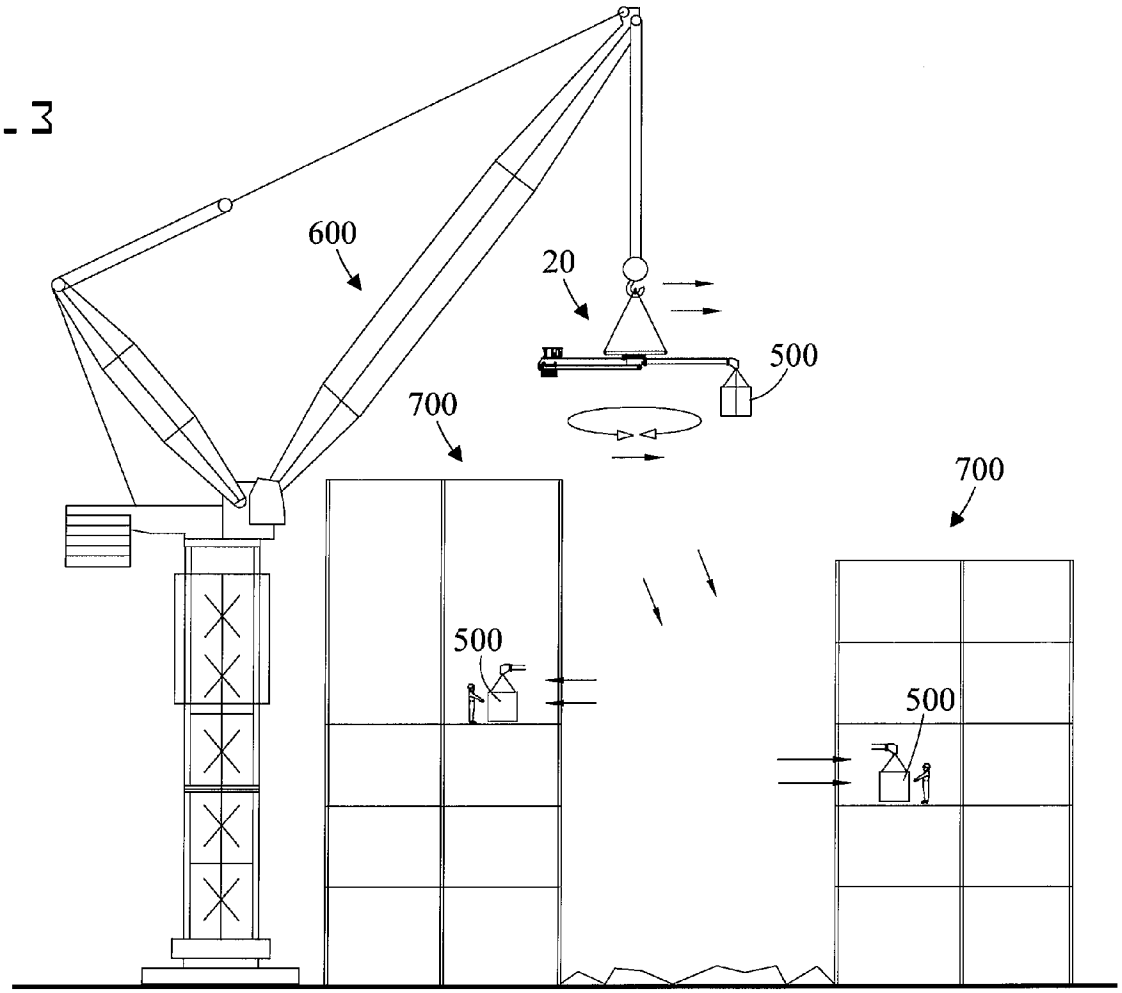
FIG. 3 is another reduced side elevation view of the fly jib being used to place a load.

Referring initially to FIGS. 1-3, there are illustrated reduced side elevation views of a fly jib 20 in accordance with the present invention being used to place a load 500 inside a building 700 having a target area 702. Fly jib 20 cooperates with a ground crane 600 having a load block 602. Fly jib 20 is connected to load block 602 by four rope slings 604. Load block 602 and slings 604 allow fly jib 20 to be positioned for load pick-up and movements to required locations inside building or cavities. Fly jib 20 is held horizontal by a balance mechanism which includes a travelling counterweight which balances the weight of the load that is being lifted. Fly jib 20 stays in the horizontal position as it is moves and operates. FIGS. 1 and 2 show ground crane 600 positioning load 500 inside a building 700. In FIG. 1 fly jib 20 is maneuvered into position so that load 500 is ready to enter building 700 and be placed on target area 702. In FIG. 2 the operator with radio remote control extends fly jib 20 and load 500 into building 700 so that fly jib 20 is outside building 700 and load 500 is inside building 700 over target area 702. As fly jib 20 extends the counterweight will automatically move rearward to maintain horizontal balance of the system. When load 500 is lowered and is supported by the ground at target area 702, the counterweight will retract inward until load connection is free and can be released. Fly jib 20 is then retracted by operator to the outside of the building. A very common usage for fly jib 20 is in multi-story buildings as is depicted in FIG. 3 wherein materials need to be placed into the rooms of the building during construction. Load 500 is extended into the building and released as in FIGS. 1 and 2. It is noted that entrance into building 700 can also be assisted by lowering the boom of crane 600 and raising the crane hoist. If any rotation of fly jib 20 takes place the operator can rotate fly jib 20 to a desired angular position as required.

Figure 4:
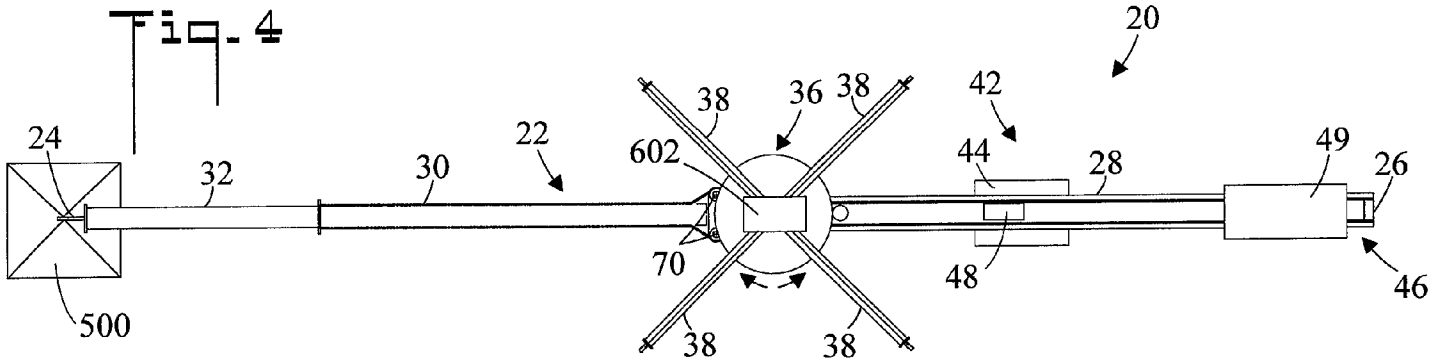
FIG. 4 is a top plan view of the fly jib.
Figure 5:
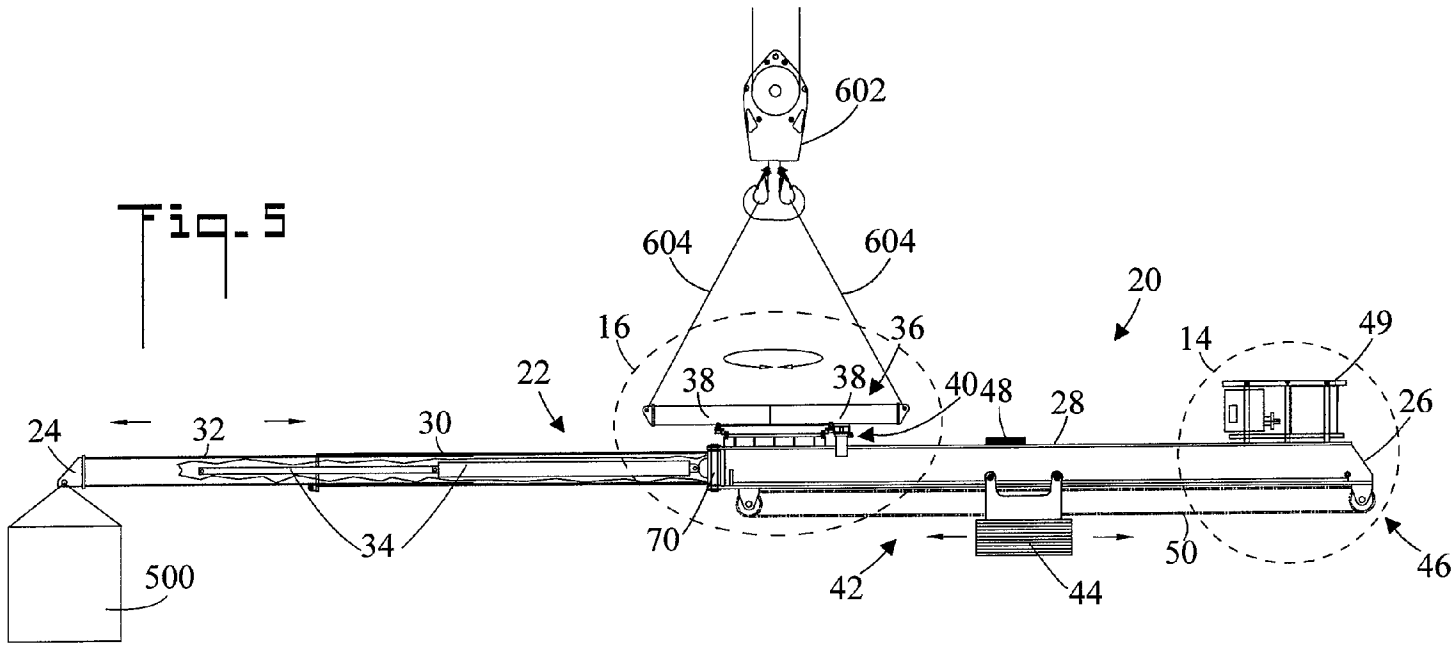
FIG. 5 is a side elevation view of the fly jib.

Now referring to FIGS. 4 and 5, there are illustrated top plan and side elevation views respectively of fly jib 20. Fly jib 20 includes a variable length beam 22 which has a load connection end 24 and an opposite end 26. That is, the length of variable length beam 22 is selectively remote controllable by an operator so that load 500 can be moved over target area 702 (refer to FIGS. 1 and 2). Variable length beam 22 includes a main beam 28, a load beam 30 connected to main beam 28, and a telescoping beam 32 which is received by and is selectively extendable from load beam 30. As is shown in FIG. 5 cutaway view, the extension of telescoping beam 32 is effected by an hydraulic cylinder 34. Telescoping beam 32 extends or retracts per operator control. Load 500 is attached to the end of telescoping beam 32, which can be extended and retracted under load.

A rotation mechanism 36 (also refer to FIGS. 16 and 17) is connected to variable length beam 22. Rotation mechanism 36 is connectable to load block 602 of crane 600 so that rotational mechanism 36 can selectively rotate variable length beam 22 with respect to load block 602 (as is indicated by the rotational arrows). Rotation mechanism 36 includes a plurality of support arms 38 which are connectable by rope slings 604 to load block 602. A disc bearing 40 (also refer to FIG. 16) rotationally connects support arms 38 to main beam 28 so that main beam 28 can be rotated with respect to support arms 38. The rotation of main beam 28 is remotely controlled by an operator.

A balance mechanism 42 is connected to variable length beam 22. Balance mechanism 42 keeps variable length beam 22 in a horizontal position (attitude). Balance mechanism 42 includes a movable counterweight 44 which is connected to main beam 28, wherein counterweight 44 is selectively longitudinally positionable along main beam 28 by a chain drive mechanism 46 (also refer to FIGS. 14 and 15). A sensor 48 is connected to main beam 28. Sensor 48 senses when main beam 28 is not horizontal and provides a signal to chain drive mechanism 46, the signal causing chain drive mechanism 46 to move counterweight 44 until main beam 28 is horizontal. The position of counterweight 44 varies as a function of the weight of load 500.

Figure 18:
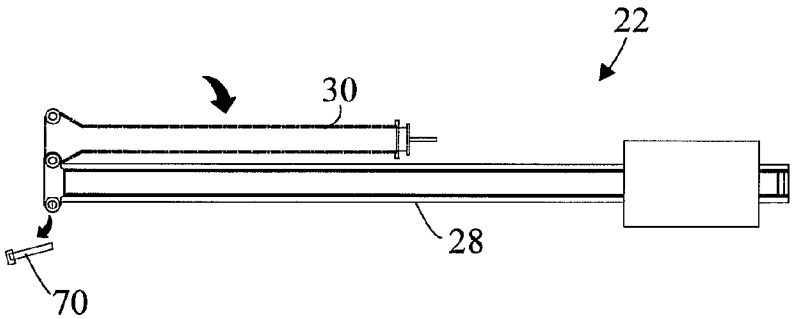
FIG. 18 is a top plan view of a variable length beam with a load beam in a folded storage position.
Figure 19:
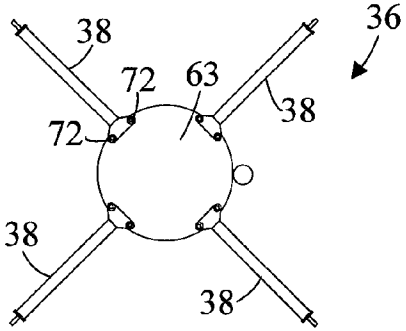
FIG. 19 is a top plan view of four support arms in a ready for use position; and, FIG. 20 is a top plan view of the four support arms in a folded storage position.
Figure 20:
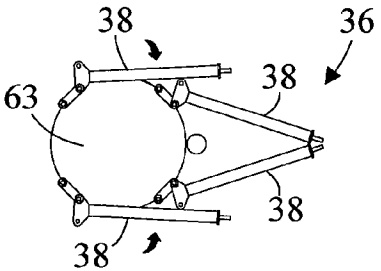

A power unit 49 is located near opposite end 26 of beam 22, and provides power for the extension of telescoping beam 32, the positioning of counterweight 44, and the rotation of fly jib 20. In an embodiment, power unit 49 is a self contained diesel power source which consists of engine, hydraulic pump, radio controlled hydraulic valving, oil reservoir and support structure. Storage rotation of variable length beam 22 as shown in FIG. 18, and support arms 38 as shown in FIGS. 19 and 20 is manually powered by an operator.

Figure 6:
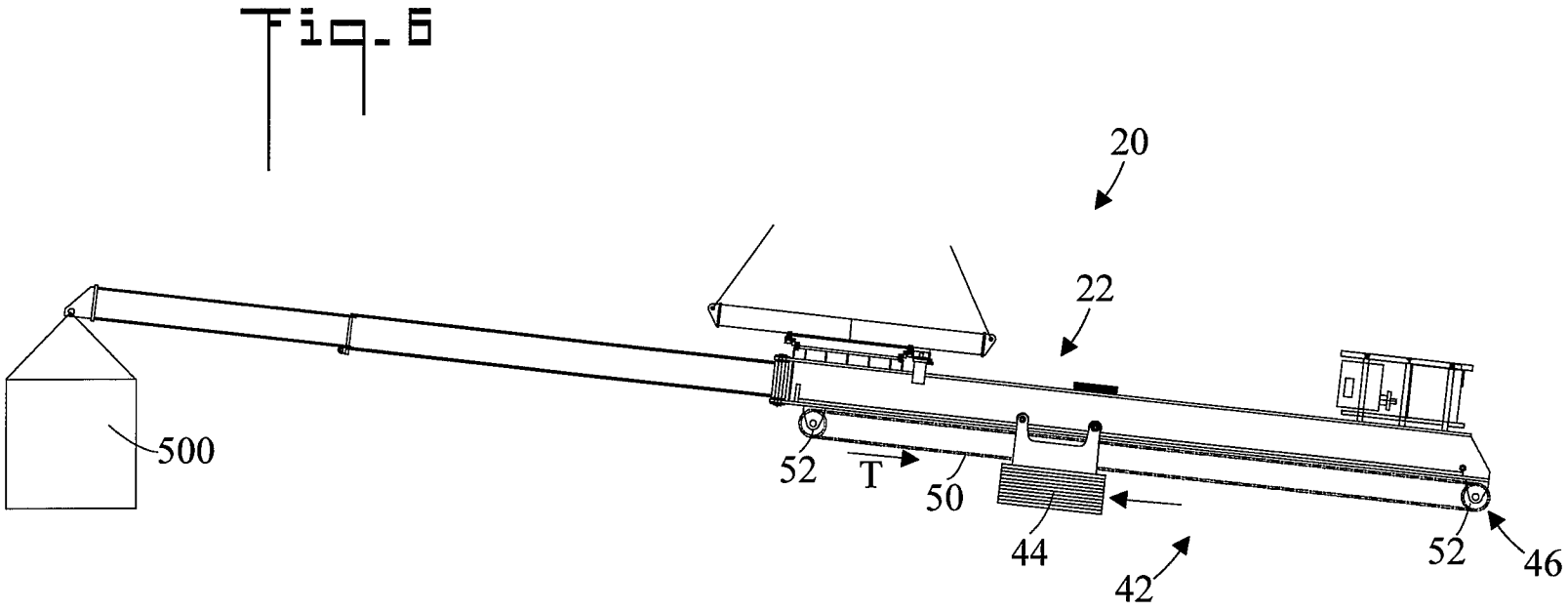
FIG. 6 is a side elevation view of the fly jib in an unbalanced state.

FIG. 6 is a side elevation view of fly jib 20 in an unbalanced state. Such a state can occur for many reasons, one of which being a malfunction in balance mechanism 42. Chain drive mechanism 46 includes a chain 50 which is connected to and effects the movement of counterweight 44. Chain 50 is driven by two toothed sprockets 52. During positioning of counterweight 44 by chain drive mechanism 46, chain 50 is always in tension T. In other words, by using a chain drive system for the long extensive travel of counterweight 44, there is no problem with compression which would cause dangerous buckling if an hydraulic cylinder were used. In the shown position, balance mechanism 42 will cause counterweight 44 to move to the left until a horizontal orientation is attained, such as in FIG. 7. It is further noted that a chain drive system permits more counterweight 44 travel than would an hydraulic cylinder positioning system. As shown, balance mechanism 42 would cause counterweight 44 to move to the left to balance variable length beam 22.

Figure 7:
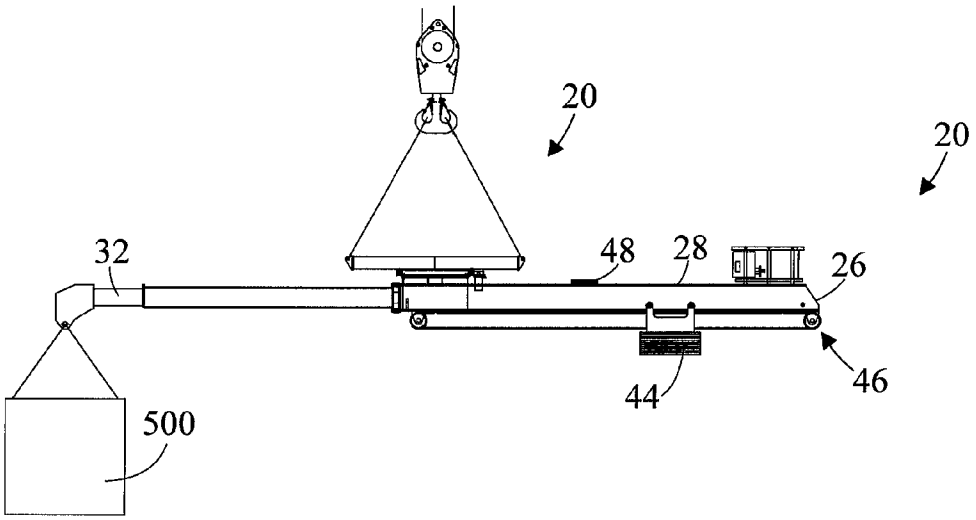
FIG. 7 is side elevation view of the fly jib supporting a load.
Figure 8:
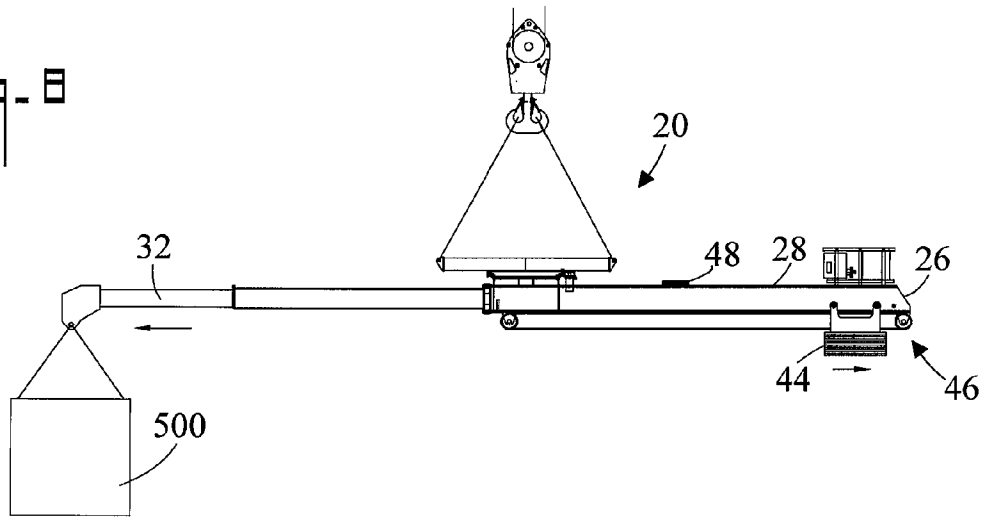
FIG. 8 is a side elevation view of the fly jib with the load extended.

FIGS. 7 and 8 are side elevation views of fly jib 20 supporting a load 500, and with load 500 extended respectively. Balance mechanism 42 via counterweight 44 keeps main beam 28 (and therefore entire variable length beam 22) horizontally oriented. The balancing is automatically controlled via a signal from sensor 48. It is noted that balance mechanism 42 can also be remotely controlled by an operator. This feature is useful to approximately position counterweight 44 before picking up a load. Then, the automatic balancing system will take over. Counterweight 44 travel is signaled from sensor 48 on main beam 28. A hydraulic motor with brake rotates a chain sprocket 52 which in turn moves chain 50 which is attached to counterweight 44, causing counterweight 44 to longitudinally travel along main beam 28 until main beam 28 is horizontal as sensed by sensor 48. In FIG. 8 telescoping beam 32 is outwardly extended. As such, balancing system 42 automatically causes counterweight 44 to move toward opposite end 26 to maintain a horizontal orientation of main beam 28.

Figure 9:
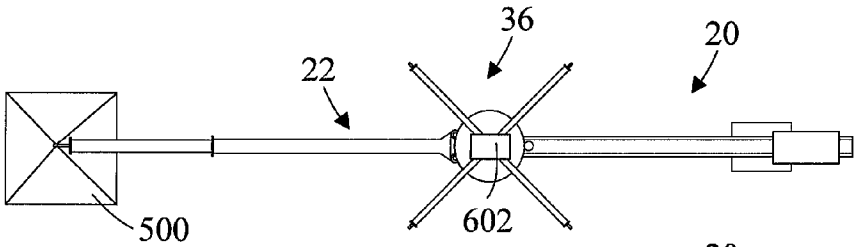
FIG. 9 is a top plan view of the fly jib in an angular position.
Figure 10:
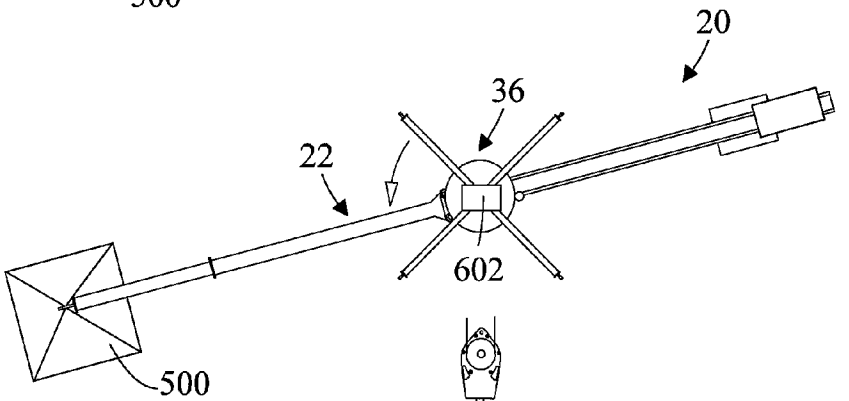
FIG. 10 is a top plan view of the fly jib in another angular position.

FIG. 9 is a top plan view of fly jib 20 in an angular position, and FIG. 10 is a top plan view of the fly jib 20 in another angular position. Under operator control, rotation mechanism 36 causes variable length beam 22 to rotate (counterclockwise as shown) with respect to load block 602. In the fashion, rotation mechanism 36 can be used to rotate variable length beam 22 and therefore load 500 to any desired angular position.

Figure 11:
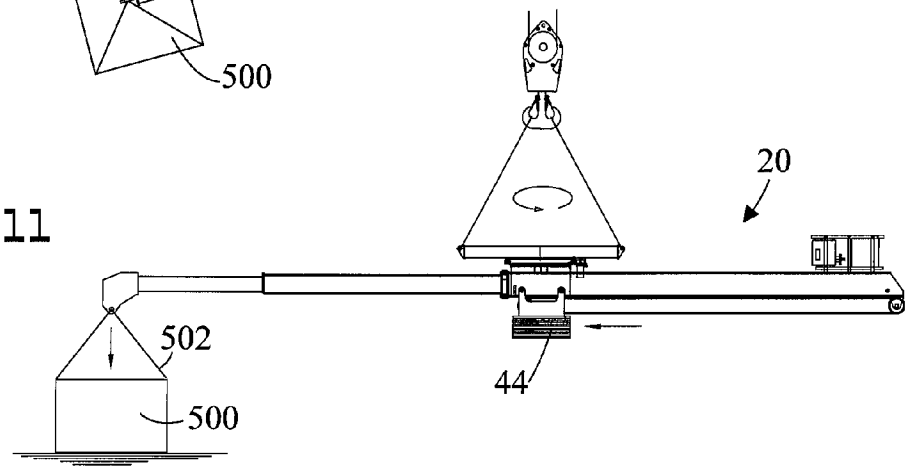
FIG. 11 is a side elevation view of the fly jib with a counterweight moved to a retracted position.

FIG. 11 is a side elevation view of fly jib 20 with counterweight 44 moved to a retracted position. The retracted position of counterweight 44 is used to disconnect fly jib 20 from load 500. In the retracted position, counterweight 44 resides substantially below rotation mechanism 36 (i.e. closest to load 500). As such tension in the cables 502 supporting load 500 is minimized or eliminated. The operator places counterweight 44 in the retracted position.

Figure 12:
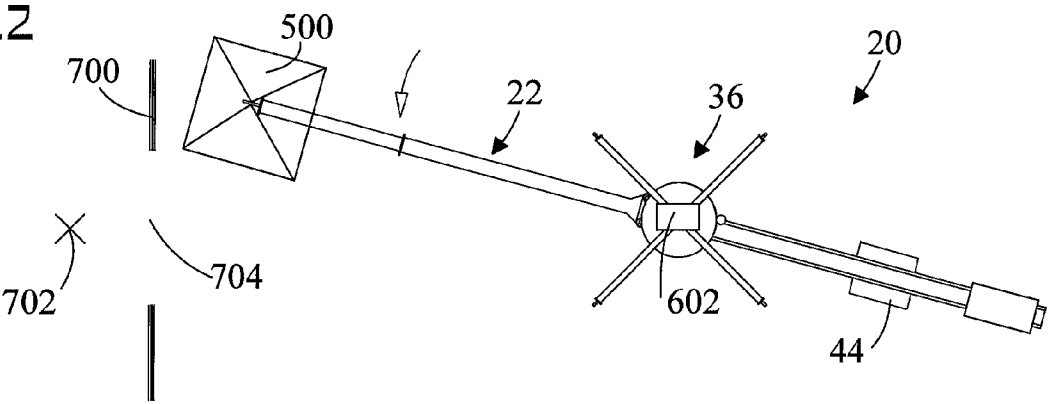
FIG. 12 is a top plan view of the fly jib in one angular position.
Figure 13:
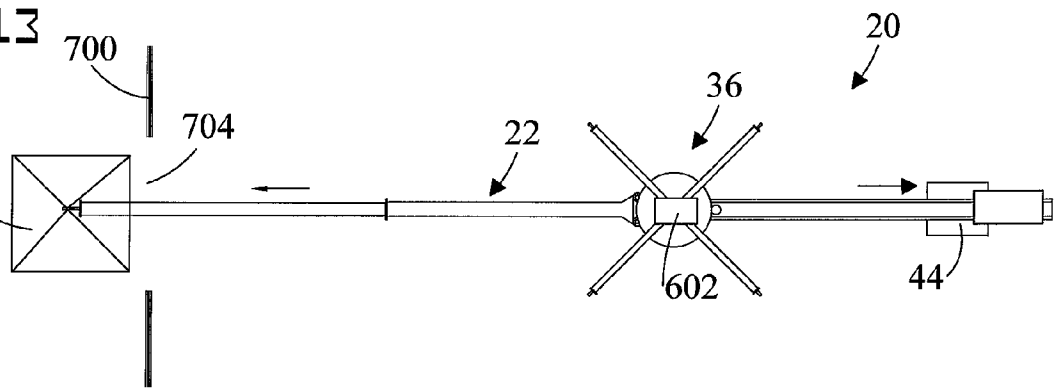
FIG. 13 is a top plan view of the fly jib rotated to another angular position.

FIG. 12 is a top plan view of fly jib 20 in one angular position, and FIG. 13 is a top plan view of fly jib 20 rotated to another angular position. In FIG. 12 fly jib is positioned outside a window 704 of a building 700. An operator then uses rotation mechanism 36 to rotate variable length beam 22 in the direction of the arrow so that load 500 is aligned with window 700. The rotation is remotely controlled by the operator, and is much safer than using long poles from window 704 to rotate the jib. Also, it is noted that load block 602 is free to rotate in accordance with OSHA requirements. As such, rotation mechanism 36 can be utilized to compensate for load block 602 rotation (such as because of wind). FIG. 13 shows variable length beam 22 rotated so load 500 is ready to enter window 704. Once aligned, telescoping beam 32 is extended so that load 500 moves into window 704 so that load 500 is positioned above target area 702. Load 500 is then lowered onto target area 702, and disconnected by first moving counterweight 44 to the retracted position of FIG. 11. Note that during the extension, counterweight 44 automatically moves away from load 500 to keep the horizontal balance.

Figure 15:
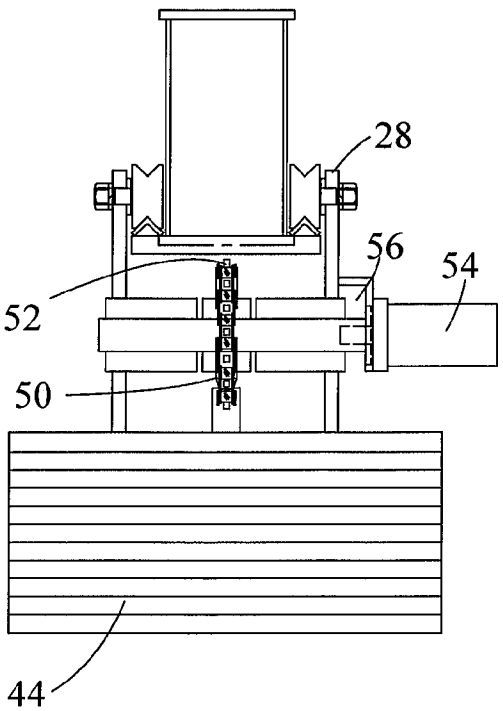
FIG. 15 is an enlarged end elevation view of FIG. 14.
Figure 14:
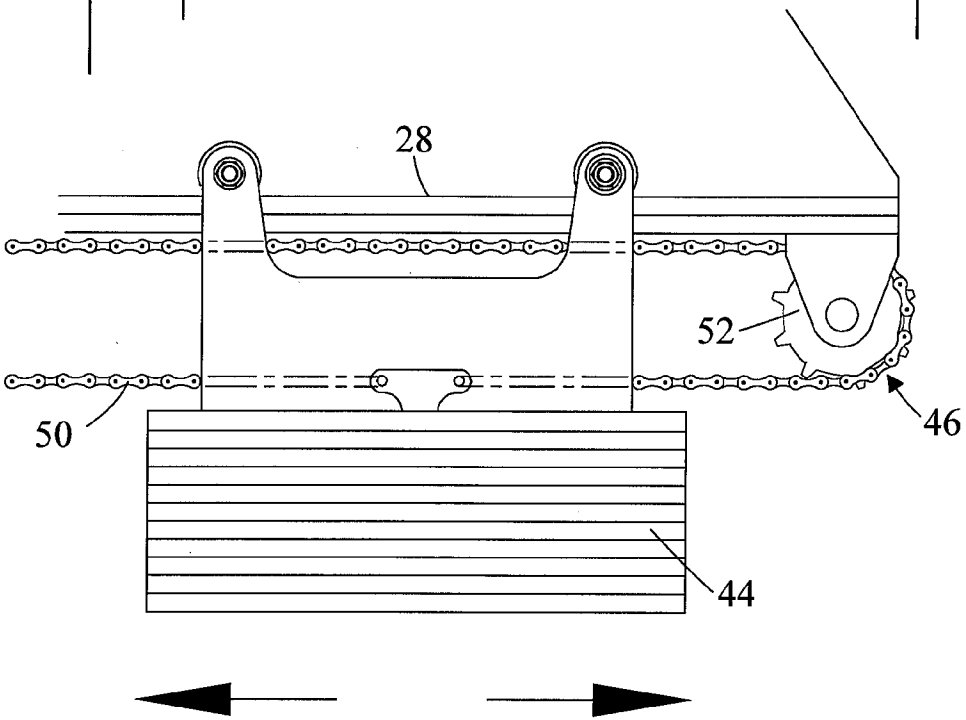
FIG. 14 is an enlarged view of area 14 of FIG. 5.

FIG. 14 is an enlarged view of area 14 of FIG. 5, and FIG. 15 is an enlarged end elevation view of FIG. 14 showing chain drive mechanism 46 which is part of balance mechanism 42 (refer to FIGS. 4 and 5. Travelling counterweight 44 is connected to toothed drive sprocket 52 by chain 50. A signal from sensor 48 (refer to FIGS. 4 and 5) causes chain drive mechanism 46 to move counterweight 44 to a location along the underside of main beam 28 so that any load 500 is balanced and main beam 28 is horizontal. A motor 54 and spring break which holds counterweight 44 at the proper location are also part of chain drive mechanism 46.

Figure 16:
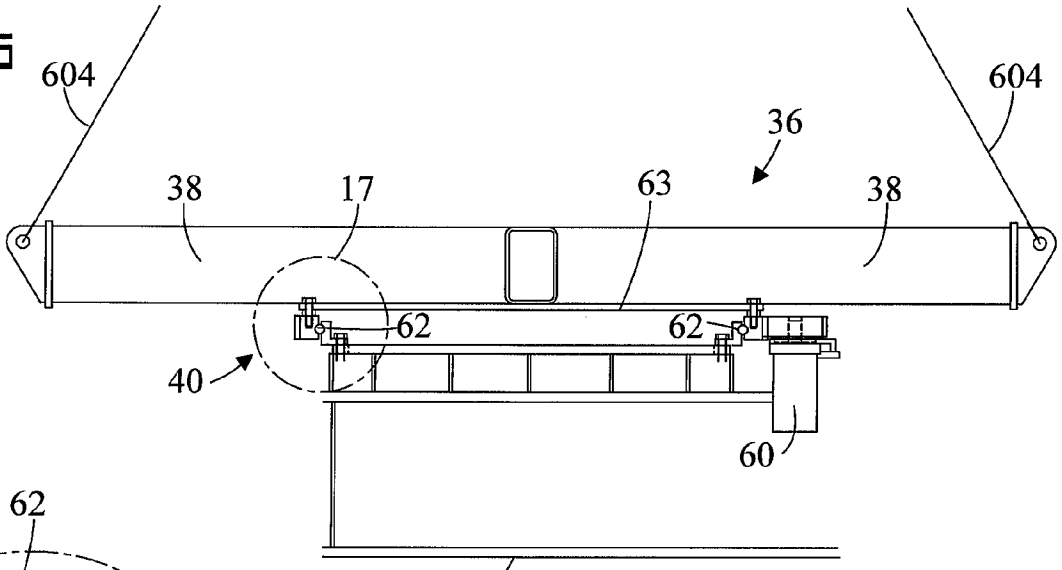
FIG. 16 is an enlarged view of area 16 of FIG. 5.
Figure 17:
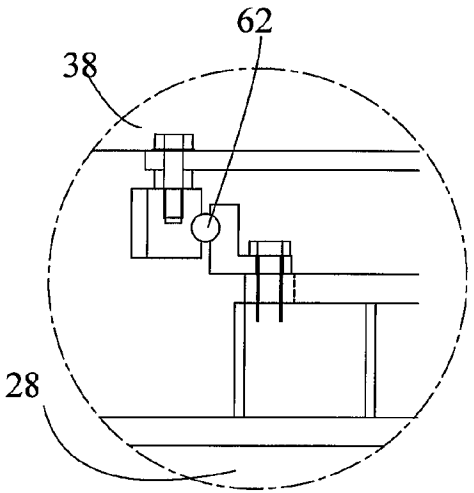
FIG. 17 is an enlarged view of area 17 of FIG. 16.

FIG. 16 is an enlarged view of area 16 of FIG. 5, and FIG. 17 is an enlarged view of area 17 of FIG. 16 showing rotation mechanism 36. Rotation mechanism 36 includes a motor 60 and brake with geared pinion which drive a disc bearing (geared platform bearing) 62. Disc bearing 62 is connected between support arms 38 and main beam 28 so that main beam 28 can be rotated with respect to support arms 38. Disc bearing 62 includes a plate 63 to which support arms 38 are connected. Rotation mechanism 36 is remotely controlled and gives the operator the ability to rotate jib 20 as it delivers a load 500 into a building 700 etc (refer to FIGS. 12 and 13 and the associated discussion). If fly jib 20 did not have this rotational capability it would be difficult and dangerous to rotate the jib, which has to be accomplished by personnel using 10 feet long poles that will kick the jib to rotate and then stop the rotation for entry into the room. Via support arms 38, rotation mechanism 36 is connected to load block 602 by four rope slings 604 (refer also to FIGS. 4 and 5). As mentioned previously crane load block 602 rotates freely as it must to conform with ANSI code. This rotation can be counteracted by jib rotational mechanism 36.

FIG. 18 is a top plan view of variable length beam 22 with load beam 30 in a folded storage position. Load beam 30 is selectively positionable to an outwardly extended position co-linear with main beam 28 (refer to FIGS. 4 and 5), and to a folded back position parallel to main beam 28 as is depicted in FIG. 18. In FIG. 18, rotation mechanism 36 is not shown for clarity. To effect the folded back position, one of the two vertical pins 70 which normally connect load beam 30 to main beam 28 (also refer to FIGS. 4 and 5) is removed and load beam 30 is rotated about the remaining pin 70. The folded back position of load beam 30 is useful to create a smaller package for shipping in a standard container or storage.

FIG. 19 is a top plan view of in which the plurality (four) support arms 38 of rotation mechanism 36 are in a ready for use position, and FIG. 20 is a top plan view of the four support arms 38 in a folded storage position. In this embodiment, the plurality of support arms 38 are each connected to bearing 62 of rotation mechanism 36 by two bolts 72. The connection is actually to plate 63. As with load bearing above (refer to FIG. 18 and the associated discussion) one bolt 72 is removable so that support arm 38 can be placed in a folded storage position which is illustrated in FIG. 20.

In terms of use, a method for placing a load includes, (refer to FIGS. 1-20)

(a) providing a load 500;

(b) providing a target area 702 for load 500;

(c) providing a crane 600 having a load block 602;

(d) providing a fly jib 20 for crane 600, fly jib 20 including;

a variable length beam 22 having a load connection end 24 and an opposite end 26, variable length beam 22 including a main beam 28, a load beam 30 connected to main beam 28, and a telescoping beam 32, telescoping beam 32 received by selectively extendable from load beam 32;

a rotation mechanism 36 connected to variable length beam 22, rotation mechanism 36 connectable to load block 602 so that rotational mechanism 36 can selectively rotate variable length beam 22 with respect to load block 602;

a balance mechanism 42 connected to variable length beam 22, balance mechanism 42 for keeping variable length beam 22 in a horizontal position;

(e) connecting rotation mechanism 36 to load block 602 of crane 600;

(f) connecting load 500 to load connection end 24 of variable length beam 22;

(g) using crane 600 to lift variable length beam 22 wherein balance mechanism 42 keeps variable length beam 22 in a horizontal position;

(h) using crane 600 to move variable length beam 22 toward target area 702;

(i) using rotation mechanism 36 to rotate variable length beam 22 to a desired angular position;

(j) causing variable length beam 22 to extend and place load 500 above target area 702;

(k) lowering variable length beam 22 until load 500 rests upon target area 702; and, (l) disconnecting load 500 from variable length beam 22.

The method further including:

in (d), variable length beam 22 including a main beam 28, in (d), balance mechanism 42 including a movable counterweight 44 connected to main beam 28, wherein counterweight 44 is selectively longitudinally positionable along main beam 28 by a chain drive mechanism 46, and a sensor 48 connected to main beam 28, sensor 48 sensing when main beam 28 is not horizontal and providing a signal to chain drive mechanism 46; and, in (g), the signal causing chain drive mechanism 46 to move counterweight 44 until main beam 28 is horizontal.

The method further including:

in (d), chain drive mechanism 46 including a chain 50 which is connected to counterweight 44; and, in (g) during positioning of counterweight 44 by chain drive mechanism 46, chain 50 always being in tension.

The method further including:

after (k) and before (l), causing counterweight 44 to assume a retracted position substantially below rotation mechanism 36.

The method further including:

in (i), rotation mechanism 36 being remotely controlled.

The method further including:

in (j), the extending of variable length beam 22 being remotely controlled.

The method further including:

in (d), load beam 30 selectively positionable to an outwardly extended position co-linear with main beam, and to a folded back position parallel to main beam 28; and, after (l), for storage placing load beam 32 in the folded back position.

The embodiments of the fly jib and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the fly jib and method should be construed as limiting the invention to a particular embodiment or combination of embodiments. The scope of the invention is defined by the appended claims.

I claim:

1. A fly jib for a crane having a load block, comprising:

a variable length beam having a load connection end and an opposite end;

a rotation mechanism connected to said variable length beam, said rotation mechanism connectable to the load block so that said rotational mechanism can rotate said variable length beam with respect to the load block; and, a balance mechanism connected to said variable length beam, said balance mechanism keeping said variable length beam in a horizontal position, said balance mechanism including a movable counterweight which is longitudinally positionable along said variable length beam, said variable length beam including a main beam, a load beam connected to said main beam, and a telescoping beam, said telescoping beam received by and hydraulically extendable from said load beam, and said rotation mechanism including a plurality of support arms which are connectable to the load block; and, a disc bearing which rotationally connects said support arms to said main beam so that said main beam can be horizontally rotated with respect to said support arms.

2. The fly jib according to claim 1, further including: said load beam selectively positionable to an outwardly extended position co-linear with said main beam, and to a folded back position parallel to said main beam.

3. The fly jib according to claim 1, further including:

said variable length beam including a main beam; said counterweight connected to said main beam, wherein said counterweight is longitudinally positionable along said main beam by a chain drive mechanism; and, a sensor connected to said main beam, said sensor sensing when said main beam is not horizontal and providing a signal to said chain drive mechanism, said signal causing said chain drive mechanism to move said counterweight until said main beam is horizontal.

4. The fly jib according to claim 3, further including: said chain drive mechanism including a chain which is connected to said counterweight; and, during positioning of said counterweight by said chain drive mechanism, said chain always being in tension.

5. The fly jib according to claim 3, the fly jib connectable to a load, the fly jib further including: said counterweight having a retracted position wherein said counterweight resides substantially below said rotation mechanism; and, said retracted position used when said fly jib is disconnected from the load.

6. A method for placing a load, comprising:

(a) providing a load;

(b) providing a target area for said load;

(c) providing a crane having a load block;

(d) providing a fly jib for said crane, said fly jib including;

a variable length beam having a load connection end and an opposite end, said variable length beam including a main beam, a load beam connected to said main beam, and a telescoping beam, said telescoping beam received by and selectively extendable from said load beam;

a rotation mechanism connected to said variable length beam, said rotation mechanism connectable to said load block so that said rotational mechanism can selectively rotate said variable length beam with respect to said load block;

a balance mechanism connected to said variable length beam, said balance mechanism keeping said variable length beam in a horizontal position;

(e) connecting said rotation mechanism to said load block of said crane;

(f) connecting said load to said load connection end of said variable length beam;

(g) using said crane to lift said variable length beam wherein said balance mechanism keeps said variable length beam in a horizontal position;

(h) using said crane to move said variable length beam toward said target area;

(i) using said rotation mechanism to rotate said variable length beam to a desired angular position;

(j) causing said variable length beam to extend and place said load above said target area;

(k) lowering said variable length beam until said load rests upon said target area; and, (l) disconnecting said load from said variable length beam.

7. The method of claim 6, further including: in (d), said variable length beam including a main beam; in (d), said balance mechanism including a movable counterweight connected to said main beam, wherein said counterweight is longitudinally positionable along said main beam by a chain drive mechanism, and a sensor connected to said main beam, said sensor sensing when said main beam is not horizontal and providing a signal to said chain drive mechanism; and, in (g), said signal causing said chain drive mechanism to move said counterweight until said main beam is horizontal.

8. The method of claim 7, further including:

in (d), said chain drive mechanism including a chain which is connected to said counterweight; and, in (g) during positioning of said counterweight by said chain drive mechanism, said chain always being in tension.

9. The method of claim 7, further including:

after (k) and before (l), causing said counterweight to assume a retracted position substantially below said rotation mechanism.

10. The method of claim 6, further including:

in (i), said rotation mechanism being remotely controlled.

11. The method of claim 6, further including:

in (j), said extending of said variable length beam being remotely controlled.

12. The method of claim 6, further including:

in (d), said load beam selectively positionable to an outwardly extended position co-linear with said main beam, and to a folded back position parallel to said main beam; and, after (l), for storage placing said load beam in said folded back position.

13. A fly jib for a crane having a load block, comprising:

a variable length beam having a load connection end and an opposite end;

a rotation mechanism connected to said variable length beam, said rotation mechanism connectable to the load block so that said rotational mechanism can rotate said variable length beam with respect to the load block;

a balance mechanism connected to said variable length beam, said balance mechanism keeping said variable length beam in a horizontal position;

said variable length beam including a main beam, a load beam connected to said main beam, and a telescoping beam, said telescoping beam received by and extendable from said load beam;

said rotation mechanism including a plurality of support arms which are connectable to the load block;

a bearing which rotationally connects said support arms to said main beam so that said main beam can be rotated with respect to said support arms;

said plurality of support arms each connected to said bearing by two bolts; and, one of said bolts being removable so that said support arm can be placed in a folded storage position.

14. A fly jib for a crane having a load block, the fly jib connectable to a load, the fly jib comprising:

a variable length beam having a load connection end and an opposite end;

a rotation mechanism connected to said variable length beam, said rotation mechanism connectable to the load block so that said rotational mechanism can rotate said variable length beam with respect to the load block;

a balance mechanism connected to said variable length beam, said balance mechanism keeping said variable length beam in a horizontal position;

said variable length beam including a main beam, a load beam connected to said main beam, and a telescoping beam, said telescoping beam received by and extendable from said load beam;

said load beam positionable to an outwardly extended position co-linear with said main beam, and to a folded back position parallel to said main beam;

said rotation mechanism including a plurality of support arms which are connectable to the load block;

a disc bearing which rotationally connects said support arms to said main beam so that said main beam can be rotated with respect to said support arms;

said balance mechanism including a movable counterweight connected to said main beam, wherein said counterweight is longitudinally positionable along said main beam by a chain drive mechanism;

a sensor connected to said main beam, said sensor sensing when said main beam is not horizontal and providing a signal to said chain drive mechanism, said signal causing said chain drive mechanism to move said counterweight until said main beam is horizontal;

said chain drive mechanism including a chain which is connected to said counterweight;

during positioning of said counterweight by said chain drive mechanism, said chain always being in tension;

said counterweight having a retracted position wherein said counterweight resides substantially below said rotation mechanism; and, said retracted position used when said fly jib is disconnected from the load.

* * * * *